United States Patent [19]

Stauff

[11] 4,050,351

[45] Sept. 27, 1977

[54] ASSEMBLY FOR LAUNCHING A PROJECTILE

[75] Inventor: Emile J. Stauff, Versailles, France

[73] Assignee: Societe Anonyme Dite: Societe Europeenne dePropulsion, Puteaux, France

[21] Appl. No.: 683,001

[22] Filed: May 4, 1976

[51] Int. Cl.[2] ..... F41F 3/02; F41F 15/00

[52] U.S. Cl. ..... 89/1.701; 89/1.705; 89/1.818

[58] Field of Search ..... 89/1.7, 1.701, 1.704, 89/1.705, 1.706, 1.818

[56] References Cited

U.S. PATENT DOCUMENTS

| | | | |
|---|---|---|---|
| 1,280,579 | 10/1918 | Stone et al. | 89/1.7 |
| 2,156,605 | 5/1939 | Prettyman | 89/1.701 |
| 3,369,455 | 2/1968 | Jones | 89/1.818 |
| 3,779,130 | 12/1973 | Schnabele | 89/1.701 |
| 3,815,469 | 6/1974 | Schubert et al. | 89/1.701 |
| 3,886,841 | 6/1975 | Smith et al. | 89/1.818 X |

FOREIGN PATENT DOCUMENTS

| | | | |
|---|---|---|---|
| 404,815 | 7/1943 | Italy | 89/1.7 |
| 624,582 | 6/1949 | United Kingdom | 89/1.7 |

*Primary Examiner*—David H. Brown

*Attorney, Agent, or Firm*—Fulwider, Patton, Rieber, Lee & Utecht

[57] ABSTRACT

An assembly for launching a projectile comprises a launch tube having a smooth or rifled bore, a charge of gunpowder located in the tube for firing a projectile which is placed in the tube in front of the charge, a braking propellant located in the tube behind the gunpowder charge and carrying a ballast material, and means ensuring that the gunpowder charge is ignited before the braking propellant. The braking propellant may be connected to a projectile by means of a sleeve to form a rigid unit which is loadable in the launch tube, the sleeve containing the gunpowder charge.

17 Claims, 7 Drawing Figures

ASSEMBLY FOR LAUNCHING A PROJECTILE

The present invention relates to the launching of a projectile from a launch tube. In this event it is desirable that the reaction on the firing position is negligable; that a high acceleration of the projectile is obtained; and that a minimum amount of gas is discharged from the front of the tube, and to a lesser extent from the rear of the tube, in order to reduce the "signature" of the launching, that is to say, the ease with which the point of launch may be spotted due to emission of smoke and gas, and to disturb the projectile and its guide-system, if any, as little as possible.

It is already known from, for example, French Pat. No. 943,319 to provide firing apparatus comprising a combustion chamber freely movable in a gun barrel which is open at both ends, the combustion chamber having compartments which are completely separated from one another and in which are arranged propellant charges. One of these charges, which is the first to be ignited and is arranged in the compartment open towards the rear of the barrel, is used to damp the recoil due to the discharge of the shot, while the other propellant charge, which is mounted in the compartment open towards the projectile and is ignited second, is used for propelling the projectile from the barrel. As mentioned, in an arrangement of this kind it is the rearward charge which is ignited first, and one consequence is that accuracy of fire is not very good.

According to this invention, a projectile is launched from a launch tube having a smooth or rifled bore by means of a charge of gunpowder located in the tube behind the projectile, a braking propellant arranged behind the gun-powder charge and carrying a ballast material, and means for ensuring that the gun-powder is ignited before the braking propellant and therefore that the projectile is discharged.

The ballast material is preferably in powdery or liquid form, which will cause the ballast to be braked rapidly in air. Particularly suitable for ballast material are grains of sand.

Preferably, the charge of gun-powder is contained in a cylindrical sleeve which also serves to connect a projectile to the braking propellant so that a rigid unit is formed which comprises the projectile, the gun-powder, and the braking propellant, and which is loadable as a unit into the launch tube. Such a unit is itself novel and forms an important aspect of the present invention. A sealing diaphragm, which may form part of the unit, may be provided behind the braking propellant, this diaphragm serving to retain the ballast before ignition of the braking propellant and being designed to break and release the ballast material when this material undergoes a negative acceleration following ignition of the propellant.

Preferably the arrangement of the launching assembly is such that the braking propellant leaves the rear end of the launch tube before the projectile leaves the front end, thereby reducing the pressure of the gases acting on the base of the projectile and consequently the amount which issues from the front end of the tube after the projectile.

An example of a launching assembly in accordance with the invention will now be described with reference to the accompanying drawings, in which.

Figure 2:
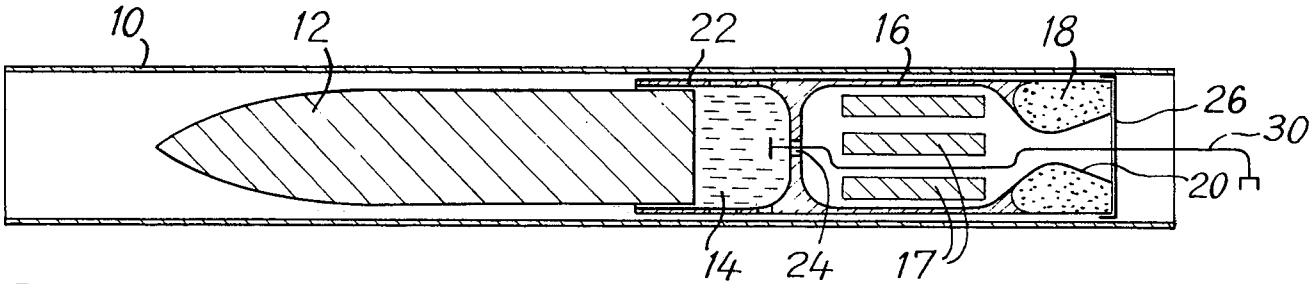
FIG. 2 is a longitudinal section through the launching assembly, showing the unit of FIG. 1 loaded in a launch tube.
Figure 3:
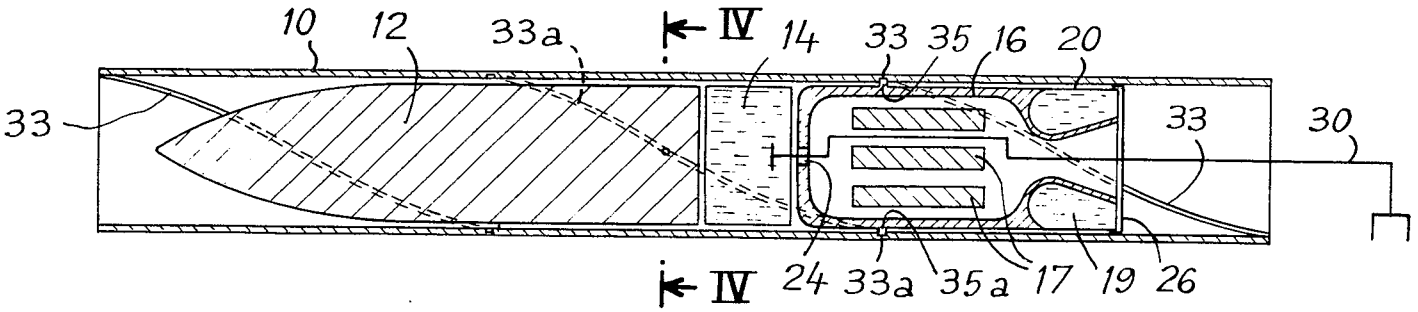
FIGS. 3 and 4 illustrate a launching assembly with a rifled launch tube and liquid ballast.
Figure 4:
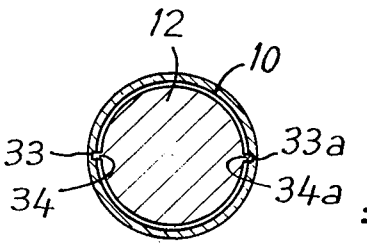
Figure 5:
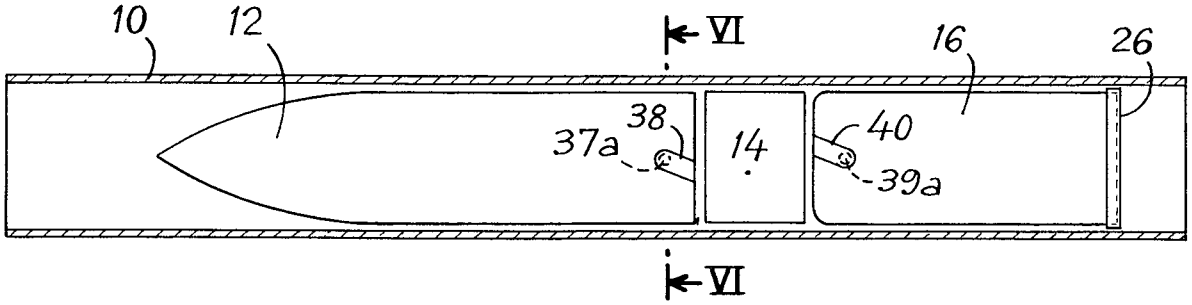
FIGS. 5 and 6 illustrate a launching assembly with oblique grooves for both the projectile and braking propellant.

FIG. 2 shows a conventional launching tube 10, which may have a smooth or rifled bore, and in which is placed a projectile 12 to be launched. A charge of gun-powder 14 is located behind the projectile 12, and behind this powder is arranged a braking propellant 16. The braking propellant 16 contains blocks of powder 17, which are not shown, and may also be furnished with a ballast material. In FIG. 2, the braking propellant 16 carries ballast 18 formed by grains of sand retained in an envelope 20. These grains of sand will exhibit the characteristic of being braked rapidly in air whilst having a terminal velocity of fall, given by Stokes' formula, greater than the particles contained in the smoke emitted during the discharge of the projectile. They are therefore less visible and for a shorter time than this smoke. Liquid ballast can also be used as shown in FIG. 3, where a liquid ballast 19 is contained in the envelope 20. FIG. 3 also shows grooves 33 and **33*a* in the inner wall of launch tube 10** to provide a rifled bore.

Figure 1:
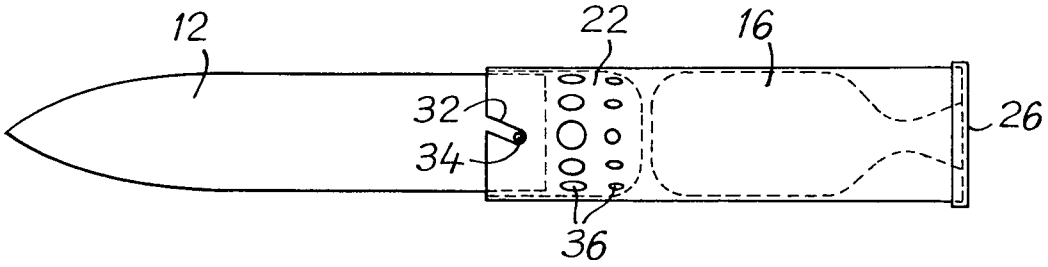
FIG. 1 is an elevation of a rigid unit which forms part of the launching assembly and which consists of the projectile connected to the braking propellant.

As shown in FIG. 1 the braking propellant 16 is connected to the projectile 12 by a sleeve 22, the gunpowder 14 provided for propelling the projectile being contained within the sleeve 22. The assembly represented in FIG. 1 consisting of the projectile 12, the gunpowder 14, and the braking propellant 16 furnished if necessary with its ballast 18, constitutes a rigid loadable unit.

The cylindrical sleeve 22 which connects the braking propellant 16 and the projectile 12 contains a series of apertures 36, which may be drilled, and which are opened progressively as the braking propellant leaves the tube, thus enabling the expansion of the gases from the gunpowder to be spaced slightly.

Behind the braking propellant 16 a sealing diaphragm 26 is provided, which at the same time serves to retain the ballast before ignition of the braking propellant.

In this example an electrical ignition system 30 for the gunpowder 14 is shown passing through the nozzle of the braking propellant 16, and operation of the launching assembly is as follows: At the instant of firing, the gunpowder 14 is ignited by the firing system 30, and the pressure of the resulting gases unlocks the projectile from the sleeve 22 of the propellant 16.

The projectile of mass $M_1$ acquires a velocity of $V_1$ at a given instant, and the ballasted propellant of total mass $M_2$ acquires a velocity $V_2$. Neglecting for a first approximation the thrust of the braking propellant, which is going to be ignited by the gases from the gunpowder passing through a gauged orifice 24 provided for this purpose, one can write:

$$M_1 V_1 = M_2 V_2$$

The centre of gravity of the two masses remains fixed.

If, for example, $M_2 = 2M_1$, one has at every instant:

$V_2 = V_1/2$ and the distances covered are in the same ratio.

Figure 7:
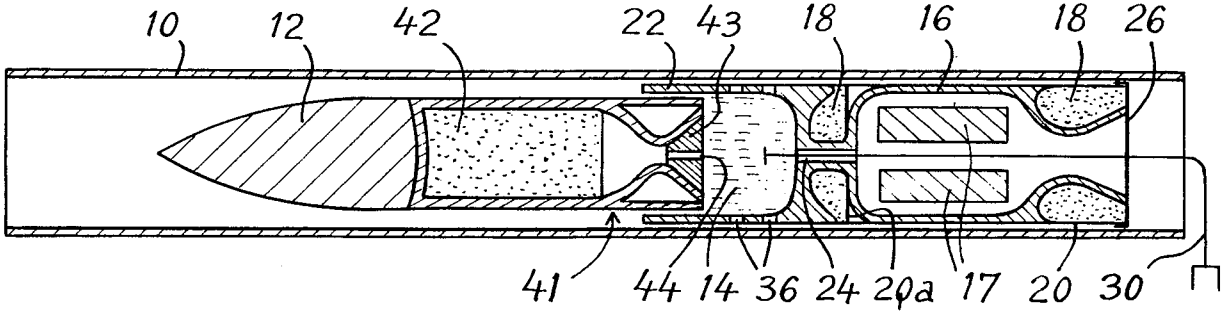
FIG. 7 shows the embodiment of FIG. 2 with a cruising propellant.
Figure 6:
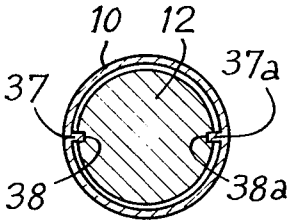

If the projectile 12 carries a cruising propellant it may be ignited by letting the gases from the ignited gunpowder penetrate through the nozzle of the propellant, via a guard orifice limiting the pressure. It has been mentioned above tha the braking propellant is intended to be ignited in a similar way, the dimensions of the guaged hole 24, or holes, provided for this purpose being a function of the volume to be filled and of the delay required for the ignition. Referring now to FIG. 7, the assembly can have a cruising propellant 42 with means 43 defining a gauged orifice 44 through which ignition of the cruising propellant is effected by gases from the ignited gunpowder charge.

Ignition of the braking propellant 16 provides a braking thrust P, which may be taken into account in analysing the motions, by writing that the centre of gravity of $(M_1 + M_2)$ undergoes an acceleration of:

$$P/M_1 + M_2$$

This acceleration will, in general, be negligible compared with that obtained by the gun effect.

The length of the launch tube 10, and the masses and arrangement in the tube of the projectile 12, the gunpowder 14, the braking propellant 16 and possible ballast 18, is such that the tube is open first towards the rear, that is to say, the braking propellant 16 leaves the tube before the projectile. In this case, the larger amount of gas is discharged from the rear of the tube. It is desirable that the projectile 12 leaves the tube 10 only when the expansion wave has reached it, in order to limit the pressure of the gas on the base of the projectile and hence reduce to a minimum the amount of gas discharged from the front of the tube after the projectile.

It can be shown that the thrust P from the braking propellant 16 may be such that it is braked over a distance of the order of 2 to 4 meters.

The total amount of powder consumed and hence the smoke and flame produced are most certainly a little greater with a launching assembly in accordance with the invention than those produced by a gun giving the same velocity to the projectile, but are much less than those brought into play using a conventional acceleration propellant or recoilless gun.

In this preferred embodiment of the invention the connection between the projectile and the sleeve 22 of the braking propellant is provided with means which causes an angular acceleration $dw/dt$ to be given to the projectile when the projectile is fired. It goes without saying that after separation of the projectile from the launching system shown in FIG. 2:

$$I_1 w_1 + I_2 w_2 = 0$$

$I_1$, $I_2$, $w_1$, $w_2$ being the moments of inertia and the angular velocities of the projectile and the launching system.

In the embodiment shown, the sleeve 22 has for this purpose one or more grooves 32, which extend obliquely with respect to the axis of the tube 10, and in which engage one or more studs 34 provided at the rear of the projectile. When the projectile is fired, the displacement of the studs in the grooves as the projectile separates from the sleeve sets the projectile 12 in rotation.

It should remain clearly understood that this invention is not restricted to the embodiment just described and illustrated, but that it encompasses many variations within the scope of the claims. For example, while the presence of a sleeve 22 connecting the projectile to the braking propellant 16 is a feature of one advantageous embodiment of the invention, it may not be present in another embodiment. In this case, the projectile 12, and if necessary the braking propellant 16 may be furnished with at least one groove 38 and 40, respectively, in the outer wall extending obliquely with respect to the longitudinal axis. These grooves are arranged to receive lugs or studs **33*a* and 39*a* integral with the inner wall of the launching tube 10. Such an arrangement enables the projectile 12 and the braking propellant 16 to be set in rotation with opposite angular velocities (the slope of the grooves on the projectile and on the braking propellant with respect to the longitudinal axis being in the same directions for each of these elements) whilst minimizing the reactions upon the tube 10**. This is particularly advantageous for launch tubes of small calibre.

I claim:

1. A projectile launching assembly including a launch tube, a charge of gunpowder located in said launch tube for communication therewith upon ignition and for firing from said tube a projectile which is placed in said tube in front of said gunpowder charge, means permitting, upon firing, the application of pressure of gases from said gunpowder charge against the rear of the projectile and the inner wall of the launch tube, a braking propellant located in said launch tube behind said gunpowder charge, a ballast material carried by said braking propellant, and means for sequential ignition of said gunpowder charge followed by ignition of said braking propellant.

2. An assembly as claimed in claim 1, wherein said launch tube has a smooth bore.

3. An assembly as claimed in claim 1, wherein said launch tube has a rifled bore.

4. An assembly as claimed in claim 1, wherein said ballast material is in liquid form whereby said material is braked rapidly in air.

5. An assembly as claimed in claim 1, further including walls means separating said gunpowder charge from said braking propellant and defining at least one gauged hole whereby, in operation, said braking propellant is ignited by gases from the ignited gunpowder charge.

6. An assembly as claimed in claim 1, for launching a projectile provided with a cruising propellant, said assembly including wall means defining a gauged orifice through which ignition of said cruising propellant is effected by gases from the ignited gunpowder charge.

7. An assembly as claimed in claim 1, wherein said projectile, said gunpowder charge, and said braking propellant are located in the rear of said launch tube such that, after firing, said braking propellant leaves the rear end of said launch tube before said projectile leaves the front end of said tube, thereby causing the pressure of gases acting on the base of said projectile to be limited.

8. An assembly as claimed in claim 1, wherein said ballast material is in powdery form whereby said material is braked rapidly in air.

9. An assembly as claimed in claim 8, wherein said ballast material is sand.

10. An assembly as claimed in claim 1, further including a cylindrical sleeve connecting said braking propellant to said projectile to form a rigid unit which is loadable as a unit into said launch tube, said gunpowder charge being contained within said cylindrical sleeve and said cylindrical sleeve connecting said projectile and said braking propellant being provided with means defining a series of apertures whereby, during firing, the expansion of the gases from said gunpowder charge is effected against the inner wall of the launch tube and, after firing, said apertures are cleared progressively as said braking propellant leaves said launch tube, thereby enabling the expansion of the gases from said gunpowder charge to be spread out.

11. An assembly as claimed in claim 10, further including a sealing diaphragm behind said braking propellant, said sealing diaphragm being designed to break and release said ballast material when said ballast material undergoes a negative acceleration following ignition of said braking propellant.

12. An assembly as claimed in claim 10, wherein said cylindrical sleeve and said projectile are provided with co-operating means for causing an angular acceleration to be given to said projectile when said projectile is fired.

13. An assembly as claimed in claim 12, wherein said co-operating means comprises means defining at least one groove in said cylindrical sleeve extending obliquely with respect to the axis of said launch tube, and a stud on said projectile which engages in said groove.

14. An assembly as claimed in claim 1, wherein the bore of said launch tube is provided with means for causing a projectile to be given an angular acceleration when said projectile is fired.

15. An assembly as claimed in claim 14, wherein said means for causing angular acceleration of said projectile comprises at least one stud integral with said bore and projecting inwards for engagement in a peripheral groove in said projectile which extends obliquely to the axis of said projectile.

16. An assembly as claimed in claim 14, including means for causing said braking propellant to be given an angular acceleration of opposite sense to said projectile when said projectile is fired.

17. An assembly as claim 16, wherein said means for causing angular acceleration of said braking propellant comprises at least one stud integral with said bore of said launch tube, and means defining a peripheral groove in said braking propellant extending obliquely to the axis of said launch tube, said stud engaging in said peripheral groove.

* * * * *